US005369923A

United States Patent [19]

Schilt

[11] Patent Number: 5,369,923

[45] Date of Patent: Dec. 6, 1994

[54] WINDOW CONSTRUCTION

[75] Inventor: Piet Schilt, Ammerstol, Netherlands

[73] Assignee: Multi-Deur B.V., Netherlands

[21] Appl. No.: 19,047

[22] Filed: Feb. 18, 1993

[30] Foreign Application Priority Data

Feb. 19, 1992 [NL] Netherlands ..... 9200307

[51] Int. Cl.[5] ..... E06B 1/04

[52] U.S. Cl. ..... 52/208; 52/204.54

[58] Field of Search ..... 52/208, 203, 204.5, 52/204.54, 212, 213, 788, 789, 400, 211, 204.62, 204.67, 204.68, 204.53, 171 VP; 428/34, 38, 46; 220/662, 663, 665; 126/200; 976/DIG. 360

[56] References Cited

U.S. PATENT DOCUMENTS

| | | | |
|---|---|---|---|
| 1,461,487 | 7/1923 | Laibach . | |
| 2,710,994 | 6/1955 | Mills | 52/208 |
| 2,796,039 | 6/1957 | Brave | 49/13 |
| 3,037,589 | 6/1962 | Cole | 52/212 |
| 3,203,053 | 8/1965 | Lane et al. | 52/204.54 |
| 3,238,574 | 3/1966 | Martin et al. | 52/788 |
| 4,525,961 | 7/1985 | Hansen | 52/208 |

FOREIGN PATENT DOCUMENTS

| | | | |
|---|---|---|---|
| 0163374 | 4/1985 | European Pat. Off. | E06B 7/30 |

*Primary Examiner*—Michael Safavi
*Attorney, Agent, or Firm*—Deveau, Colton & Marquis

[57] ABSTRACT

Window construction, intended to be placed in a door, panel or wall, in particular of so-called sandwich construction, the window construction comprising an outer part and an inner part, each composed of a window of transparent material, merging into a peripheral edge provided with means for fastening the outer or inner part, while annular coverings are present, separate from the peripheral edge and the window, in order to conceal the inside of the panel or the wall from view. Said annular coverings are each quadrilaterally symmetrical, but have mutually different dimensions, so that they can be slid into each other during fitting.

3 Claims, 2 Drawing Sheets

WINDOW CONSTRUCTION

FIELD OF THE INVENTION

The invention relates to a window construction, intended for placing in a door, panel or wall, in particular a door, panel or wall of so-called sandwich construction.

The abovementioned sandwich construction is understood to be an element consisting of two thin-walled shells between which there is a core of light material. Flexible garage doors are often constructed of such elements.

STATE OF THE ART

A window construction is of this general type known, from EP-B1-0,163,374, which comprises an outer part and an inner part, each composed of a window of transparent material, merging into a peripheral edge provided with means for fastening the outer or inner part, and in which the peripheral edge is intended to come to rest against the inside or outside of the panel or the wall, while coverings are present to conceal the inside of the panel or the wall from view, and which coverings also act as centering means for the outer part and the inner part.

What characterises this known construction is that the outer part and the inner part not only comprise a window of transparent material which merges into a peripheral edge for the fastening, but that the covering is also made integral therewith. Moreover, said coverings are divided along the line of symmetry parallel to a pair of sides, so that the half at one side of the divide is placed further outwards than the half at the other side. The main shape of the two parts is thus identical, and suitable for fitting if one part is given a half turn relative to the other, so that one half can always slide along the other half when the parts are pressed against the panel or the wall during fitting. The fastening means are also identical; they are drilled through from the inside after fitting, so that a fixing screw can engage in a projection provided on the outer part.

The advantage of this window construction, is that the whole unit is cheap to produce in large numbers; only a single part needs to be manufactured.

However, according to the present invention a drawback of the known construction is that the choice of the material is limited by various requirements. The window must, of course, be transparent and impact-resistant, while the coverings, on the contrary, absolutely must not be transparent. Making the window transparent therefore necessitates a special treatment.

OBJECT OF THE INVENTION

The main object of the present invention is to provide a window construction suitable for sandwich panels which can have a varying thickness (in particular garage doors are often of this type). Another object is that cheaper material can be used for the non-transparent coverings, in particular waste material or recycled plastic.

SUMMARY OF THE INVENTION

The window construction according to the invention realizes these objects by proposing that the coverings are annular parts, separate from the peripheral edge and the window, which annular parts are each quadrilaterally symmetrical, but have different dimensions such that during fitting they are slidable into each other.

The fact that the annular parts are both simply quadrilaterally symmetrical also results in a greater strength than the known construction, where at two diametrically opposite places fillets are present with a break in the material at the transition.

In order to be able to obtain a connection in a constructionally simple, but still reliable way between the window parts and the covering rings, and starting from the fact that it is already known that the fixing means can be formed by projections moulded onto the peripheral edges for receiving the head part or the threaded end part of fixing screws, the construction according to the invention is further characterised in that the covering rings in cross-section have an L-profile, and in that the leg of the L-shape which comes to lie parallel to the window face is provided with openings in which the projections fit.

In this way the centering function of the covering means is, of course, also guaranteed in the optimum way.

Furthermore, it is advantageous according to the invention if the projections for receiving the head part of the fixing screws are hollow, so that the heads come to lie recessed.

The invention will be explained below with reference to the appended drawings of a preferred embodiment.

SHORT DESCRIPTION OF THE DRAWINGS

THE PREFERRED EMBODIMENT

Figure 1:
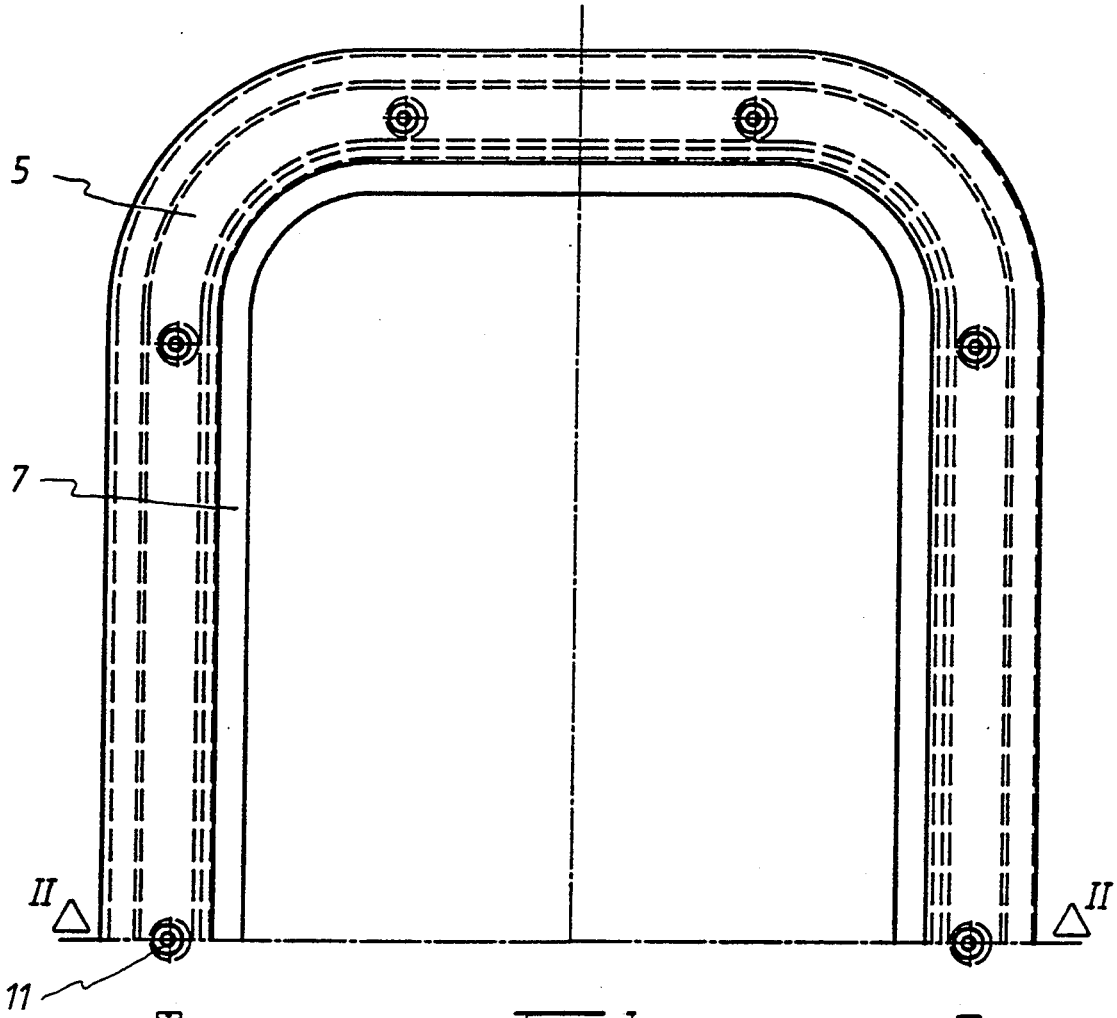
FIG. 1 is a half view towards the window, seen from the inside.
Figure 2:
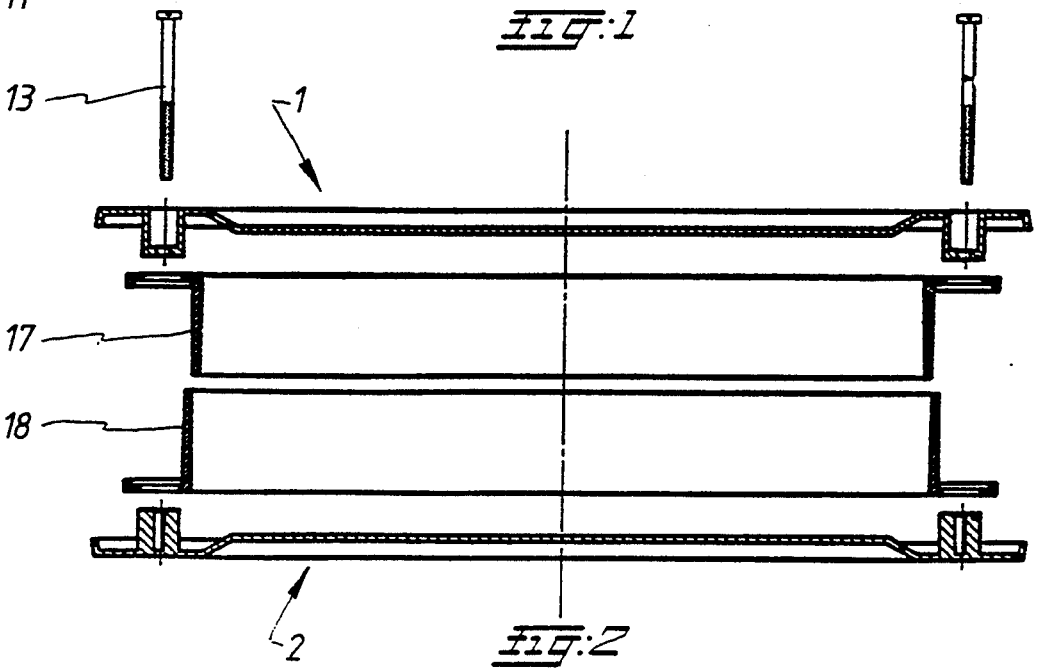
FIG. 2 is a cross-section through the window, along the arrows II—II in FIG. 1, with dismantled parts shown.
Figure 3:
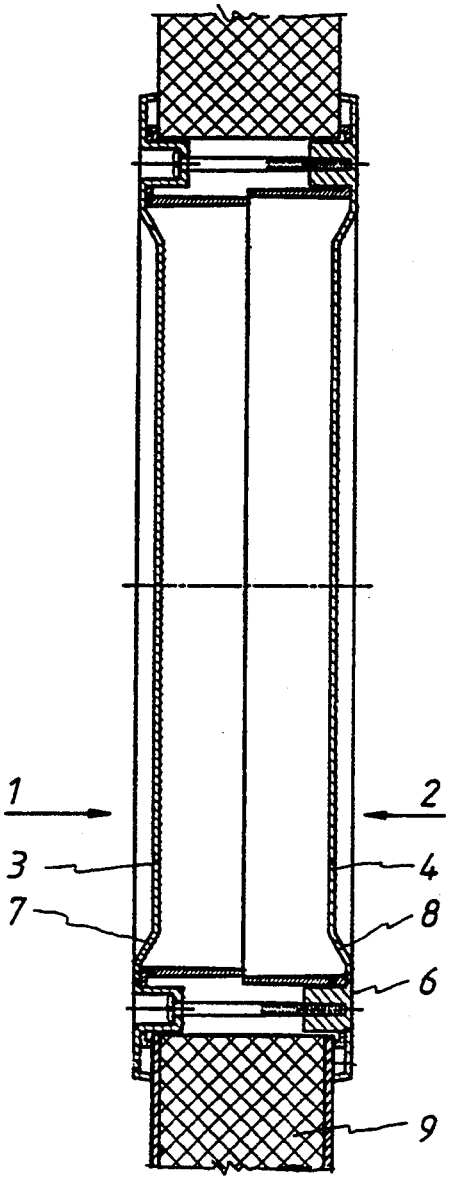
FIG. 3 shows a section through the window construction in the fitted state, in which a part of the panel or the wall is also shown.
Figure 4:
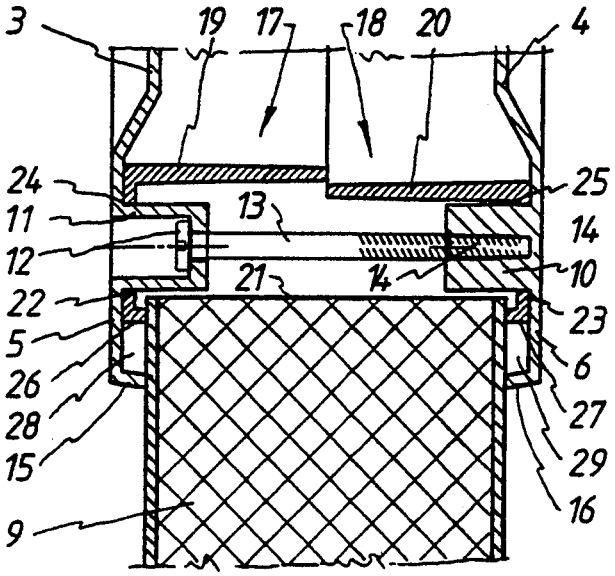
FIG. 4 shows a detail of FIG. 3 on a larger scale.

It can be seen in FIG. 2 that the window construction is composed of four different parts. FIGS. 3 and 4 show that the inner part 1 consists of the actual window 3, of transparent material, onto which a peripheral edge 5 is moulded, in the embodiment shown having a slanting transitional part 7, as a result of which the window face 3 comes to lie recessed relative to the edge part 5, and thus goes substantially into the same plane as the outside of the panel or the wall 9 in which the window is to be fitted.

The outer part 2 also consists of a window part 4 with an integral peripheral edge 6 and a fillet part 8. The outer and the inner part are of the same shape thus far.

The edge 6 of the outer part 2 is provided with inward-pointing projections 10 at a number of places (see in particular FIG. 4). At corresponding places the edge 5 of the inner part is provided with inward-pointing projections 11 which are made hollow, so that the head 12 of a bolt 13 can be recessed therein. The threaded end 14 of this bolt is screwed into a hole provided during manufacture in the projection 10 on the outer part 2.

The peripheral parts 5 and 6 are both provided with inward-pointing end edges 15, 16, of the same shape, which can come to rest against the outsides of the panel or the wall 9.

Two separate covering parts 17, 18 are then present. They are annular, thus made quadrilaterally symmetrical, and can also be called covering rings. They derive their name from the fact that parts 19, 20, which in cross-section lie perpendicular to the plane of the window 3, 4, serve to conceal from view the inside 21 of the panel or the edge 9 in which the window opening has been made.

Both covering rings are essentially L-shaped in cross-section; standing at right angles to the covering parts 19, 20 are legs 22, 23 by means of which the covering rings can come to lie against the inside of the peripheral edges 5, 6 of the window. This is then made possible in particular through the fact that the legs 22 and 23 are both provided with a number of holes 24, 25 at the places which correspond to the fixing projections 10 and 11, and also correspond in size thereto, so that said projections can be inserted into said holes during fitting. The outer edges 26 and 27 of the legs 22 and 23 of the covering rings are directed inwards over a short distance, so that they can come to rest towards the outside of panel or wall 9 in the same way as the flanged end edges 15 and 16 of the window parts. Cavities 28 and 29 then remain between the end edges 15 and 26, on the one hand, and 16 and 27, on the other, in which cavities a strip of sealing material (not shown) can be fitted if desired.

The covering rings 17 and 18 are made different sizes from each other at the position of the legs 19 and 20. It can be seen from the drawing that the part 19 is in fact so much smaller than the part 20 that these parts can slide along each other, in order in this way to achieve a centering effect for the inner part 1 and the outer part 2 as a whole. FIGS. 3 and 4 show the situation in which the window construction is fitted on a wall or panel 9 of maximum thickness. To the extent that the thickness of the wall or the panel is smaller, the covering rings 19 and 20 will slide along each other when the screws 13 are tightened, insofar as this is necessary to permit tight fitting of the frame in its entirety.

What is claimed is:

1. A window construction for placement in a door, panel or wall, in particular the door, panel or wall being of so called sandwich construction, said window construction comprising an outer part and an inner part, each comprising a window of transparent material and a peripheral edge provided with means for fastening said outer and inner parts to each other, and wherein said peripheral edges are adapted to rest against the inside or outside surface of the panel, door or wall, said window construction further comprising coverings to conceal the inside portion of the panel, door or wall from view, said coverings also acting as centering means for said outer part and said inner part, and wherein said coverings are annular pans, separate from said outer part and said inner part, which annular parts are each quadrilaterally symmetrical but have mutually different dimensions, such that during fitting they are telescopically slidable into one another to accommodate doors, walls or panels of various thicknesses.

2. A window construction as claimed in claim 1, wherein said means for fastening are formed by projections moulded onto said peripheral edges for receiving a head part or a threaded end part of threaded fasteners, and wherein further said covetings are L-shaped in cross-section, a leg of the L-shape which comes to lie parallel to the door, panel or wall being provided with apertures in which said projections fit.

3. A window construction as claimed in claim 1, wherein said means for fastening are formed by projections moulded onto said peripheral edges for receiving a head part or a threaded end part of threaded fasteners, said projections being generally hollow for receiving the head part of the threaded fasteners, so that the heads come to lie recessed, and wherein further said covetings are L-shaped in cross-section, a leg of the L-shape which comes to lie parallel to the door, panel or wall being provided with apertures in which said projections fit.

* * * * *